United States Patent [19]

Keritsis et al.

[11] Patent Number: 4,756,316

[45] Date of Patent: Jul. 12, 1988

[54] METHOD FOR PRODUCING A CIGARETTE FILTER ROD

[75] Inventors: Gus D. Keritsis; Walter A. Nichols, both of Richmond, Va.

[73] Assignee: Philip Morris Incorporated, New York, N.Y.

[21] Appl. No.: 764,601

[22] Filed: Aug. 12, 1985

[51] Int. Cl.[4] ..... A24C 5/52

[52] U.S. Cl. ..... 131/94; 493/47; 493/49

[58] Field of Search ..... 131/94, 88; 493/47, 493/49

[56] References Cited

U.S. PATENT DOCUMENTS

| | | | |
|---|---|---|---|
| Re. 26,604 | 6/1969 | Dunlap . | |
| 2,900,988 | 8/1959 | Crawford et al. . | |
| 2,966,198 | 12/1960 | Wylde | 154/1.7 |
| 3,311,115 | 3/1967 | Mueller et al. . | |
| 3,400,722 | 9/1968 | Noznick et al. . | |
| 3,489,827 | 1/1970 | Mueller et al. . | |
| 4,076,031 | 2/1978 | Grossman . | |
| 4,099,913 | 7/1978 | Walter et al. . | |
| 4,118,526 | 10/1978 | Gregorian et al. . | |
| 4,181,770 | 1/1980 | Schuhmacher et al. . | |
| 4,232,087 | 11/1980 | Trask . | |
| 4,365,968 | 12/1982 | Gregorian et al. . | |
| 4,476,807 | 10/1984 | Pryor . | |
| 4,524,589 | 6/1985 | Fleissner . | |

FOREIGN PATENT DOCUMENTS

| | | |
|---|---|---|
| 1561706 | 2/1980 | United Kingdom . |

*Primary Examiner*—V. Millin

*Attorney, Agent, or Firm*—Jeffrey H. Ingerman

[57] ABSTRACT

A method for applying additives to a cigarette filter rod during its formation is disclosed. The additives are applied in the form of a liquid foam, allowing low application rates with uniform distribution. According to the method, it is not necessary to use large amounts of solvents to apply the additives, thereby avoiding overwetting of the filter material.

21 Claims, 1 Drawing Sheet

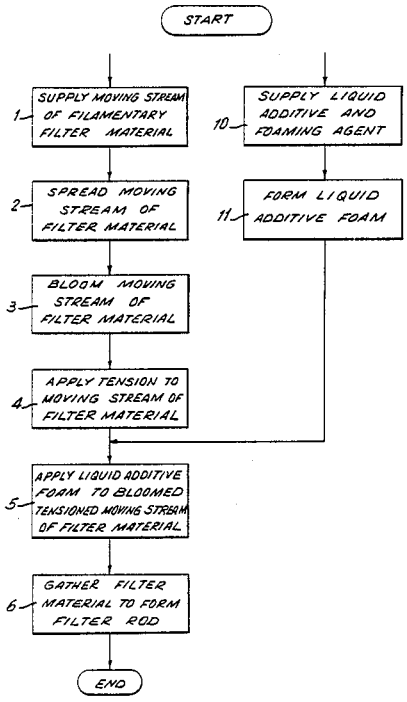

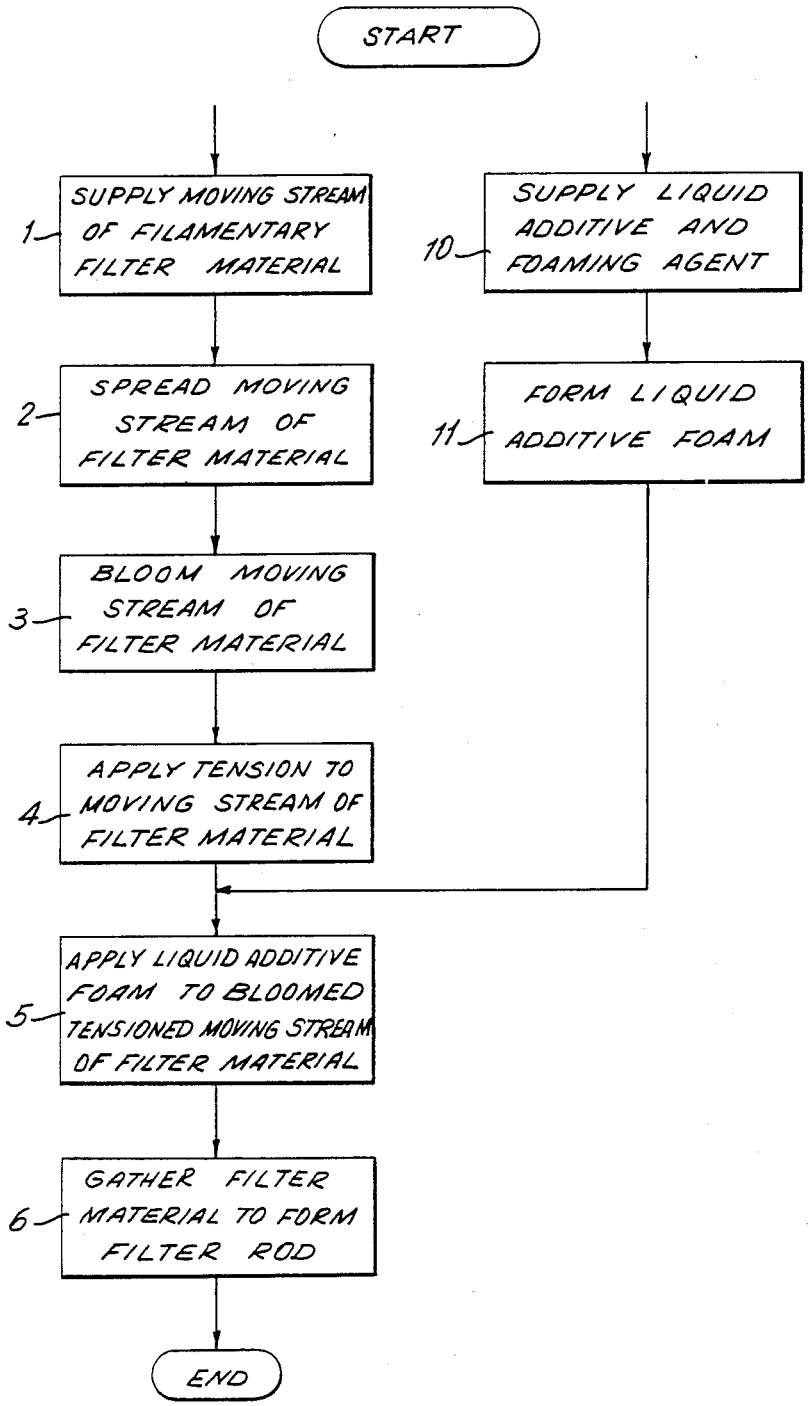
START
1
SUPPLY MOVING STREAM OF FILAMENTARY FILTER MATERIAL
2
SPREAD MOVING STREAM OF FILTER MATERIAL
3
BLOOM MOVING STREAM OF FILTER MATERIAL
4
APPLY TENSION TO MOVING STREAM OF FILTER MATERIAL
10
SUPPLY LIQUID ADDITIVE AND FOAMING AGENT
11
FORM LIQUID ADDITIVE FOAM
5
APPLY LIQUID ADDITIVE FOAM TO BLOOMED TENSIONED MOVING STREAM OF FILTER MATERIAL
6
GATHER FILTER MATERIAL TO FORM FILTER ROD
END

METHOD FOR PRODUCING A CIGARETTE FILTER ROD

BACKGROUND OF THE INVENTION

This invention relates to a method for producing a cigarette filter rod. More particularly, this invention relates to a method for applying an additive to a filter rod during its manufacture in the form of a liquid additive foam.

Cigarette filter rods are commonly made from a filamentary material. One commonly used filamentary material is cellulose acetate. More recently, filamentary polyolefin materials, particulary fibrillated polypropylene, have emerged as possible filter materials. Other filamentary materials that could be used are wood pulp fibers, cotton, flax, jute, wool, silk, ramie, protein fibers, polyamide fibers (e.g., nylon) cellulose, regenerated cellulose (e.g., rayon), other cellulose ester fibers (e.g., cellulose triacetate), acrylic fibers, polyester fibers, and polyvinyl chloride fibers. Filter rods can also be made from gathered paper.

In the case of a filamentary material, typically provided in bale form, the material is drawn into a bundle or "tow"of ten to thirty thousand filaments. The tow is then spread and fluffed up, or "bloomed", usually by being placed under tension and passed over air jets. The bloomed tow is passed through a funnel or other constricting device and then through a shaped aperture to form the filter rod. The rod is provided with an outer layer to maintain its shape, either by being wrapped with a plug wrapping of paper or other sheet material, or being heated to fuse the outermost filaments into a self-supporting layer.

A filter rod produced as described above may not be firm enough to be self-supporting or, while self-supporting, may not give a firm enough subjective feel to smokers. Therefore, plasticizers or binders are usually added to the tow during or after blooming. These additives cause the filaments to bond to each other at their crossover points when the tow is gathered, giving the rod an increased firmness. A filter rod so treated must be cured either by heating for a short time or by air-curing.

In some cases, it is desirable to apply other additives to a cigarette filter rod such as flavorings (which form an aerosol when contacted by the hot tobacco smoke and flow with the smoke into the smoker's mouth) or humectants.

It is known to apply these additives to the tow by spraying them in liquid, mist, or aerosol form onto the tow during or after blooming. With spray application methods, overspray of the additives is common. Overspray, the amount of additive which does not directly impact on the tow, causes several problems. First, controlled uniform application of additive to the tow is difficult to achieve. While accurate metering systems may be employed to measure the amount of additive sprayed, it is difficult to determine in real time what percent of additive sprayed actually is retained by the tow. Second, if the composition of the additive includes low vapor pressure solvents, spray techniques generate high concentrations of the solvent in the environment. Third, overspray of additives which are viscous or sticky tends to cause machine part contamination and the overspray cannot be collected for re-use.

In addition, it is sometimes desirable to apply an additive in small concentrations, i.e., less than about 10% of the dry filter weight. This necessitates the use of solvents to deliver a small amount of additive over the large surface area of the filaments in the tow. These solvents must then be removed by drying or by allowing them to evaporate. The solvents may also stain the plug wrapper or the overlying tipping paper. Further because of the lack of control, some of the additive is wasted. Finally, viscous additives such as binders and adhesives may contaminate machine parts in the plug making apparatus, requiring frequent cleaning, because excess additive must be used to get the proper amounts added to the tow.

It would be desirable to be able to apply additives uniformly to a cigarette filter rod without overwetting the fibrous web of the filter tow, and without contaminating machine part in the plug making apparatus.

SUMMARY OF THE INVENTION

It is an object of this invention to apply additives uniformly to a cigarette filter rod.

It is a further object of the invention to apply such additives in small concentrations without overwetting the fibrous web of the filter rod.

It is another object of the invention to apply such additives without gumming up the plug making apparatus.

In accordance with this invention, there is provided a method for producing a cigarette filter rod. The method comprises the steps of providing a moving stream of filter material, applying a liquid additive foam to the moving stream of filter material, and gathering the moving stream of filter material after the applying step, to form the cigarette filter rod.

In particular, in a method for producing a cigarette filter rod, said method including the steps of providing a moving stream of filter tow material, blooming the filter tow material in the moving stream, gathering the filter tow material to form the filter rod, and providing an outer layer for the rod, a liquid additive foam is applied to the moving stream of filter tow material after the beginning of the blooming step and before the completion of the gathering step.

BRIEF DESCRIPTION OF THE DRAWING

The above and other objects and advantages of the invention will be apparent upon consideration of the following detailed description, taken in conjunction with the accompanying FIGURE, which is a flow diagram of a preferred embodiment of the process according to this invention.

DETAILED DESCRIPTION OF THE INVENTION

The present invention involves treating a fibrous (filamentary) filter material with plasticizers or other additives applied in the form of a liquid foam. By using a liquid additive foam, the space between the fibers of the filter material can be permeated thoroughly because of the exceptional penetrating ability of liquid foam. The low density and high surface area of liquid foam also enable the application of additives in a quantity sufficient to permeate the fibrous filter material without using excessive amounts of solvents.

In general, a liquid additive foam useful in accordance with the invention, formed as at 11 in the FIGURE, will consist of a gas and either a liquid additive or an additive mixed with a liquid carrier such as water. The additive, supplied as at 10 in the FIGURE, can be, for example, a plasticizer, a humectant, a bonding agent or a flavoring, in combination with a foaming agent, a foam stabilizing agent, a wetting agent, a binder such as, for example, a film forming material, br a cross-linking agent, or combinations thereof, with or without an emulsifying agent. If the additive is a flavoring, it might be encapsulated in a resin or binder to control its rate of release during smoking.

Generally, the type of film-forming materials which are applicable to, and which may be employed in, the present invention include polymers and resins selected from the classes of polysaccharides and their derivatives, synthetic thermoplastic film formers and the like, and pastes or other derivatives obtained from natural products such as tobacco, or extracts thereof, or extracellular material from cultured tobacco cells, either with or without the cells themselves. Inorganic binders such as silicates, bentonite, etc., may also be used.

Typical foaming agents include saponines, proteins, caseinates, hydrolyzed proteins, soaps, sodium lauryl sulfate, polyglycerol esters, certain polysaccharides, and lactated esters and combinations thereof.

The method of the invention, diagrammed in the FIGURE, can be carried out using a conventional filter plug making machine and a conventional foam generating machine. A moving stream of filter tow material is drawn, as at 1, from a bale or box of the material, which can be cellulose acetate or one of the newer filter materials such as fibrillated polypropylene. The filter tow material is spread, as at 2, and bloomed, as at 3, in a conventional manner.

In conventional filter making processes, the additive would then be sprayed onto the spread bloomed tow, which would then be gathered through a funnel or other constricting device, passed through a shaped orifice, and provided with an outer layer as described above. In the process of the invention, on the other hand, the filter tow material is allowed to come into contact with the liquid additive foam, as at 5, at some point between the beginning of the blooming step, at 3, and the completion of the gathering step, at 6, so that the foam impregnates the tow. The foam can be supplied under slight pressure through a nozzle or pipe, or by any other suitable means which comes into contact with the moving stream of filter tow material. The tow must be contacted by the foam before it is too densely packed to allow penetration, but contact need not occur before the gathering step begins. It is sufficient that at least some part of the gathering step takes place after the tow is contacted by the foam. The additives are typically applied in amounts of less than about 10% of the dry filter weight, exclusive of the foaming or foam stabilizing agent.

For maximum ease of foam penetration, the tow should be held under tension, as at 4. Controlling tow tension regulates the point at which the foam collapses and penetrates the tow. The preferred method of foam application is to minimize the thickness of the tow material with tension and to apply the foam through a slot nozzle, colapsing the foam at the exit of the nozzle. An alternate method of foam application is to supply foamed additive to the surfaces of two counter-rotating rolls having an adjustable gap. The tow material is threaded through the gap in the rolls. Foamed additive is thus transferred to the tow, compressed, and collapsed. This method is particularly effective when applying very stable foam or foamed additive to thick or dense tow materials. Alternatively, dual slot nozzle systems may be utilized with such materials.

EXAMPLES

In the following examples, liquid additive foams were prepared in an Oakes Mixer, Model No. 2MT.5A, manufactured by Oakes Machine Corp., 235 Grant Avenue, Islip, New York 11751. This mixer mixes the liquid additive with air to produce a controlled density foam. A conventional cigarette filter plug making machine was fitted with a slot nozzle measuring 0.025 inch×6 inches between the feed and delivery rolls in the blooming stage of the machine. The liquid additive foam was fed under a pressure of 40 psig to the slot nozzle.

The firmness of the filters made according to these examples was measured by the Coresta test method. The Coresta firmness is defined as the compressed diameter expressed as a percentage of the initial diameter when the rod is compressed between two flat, parallel surfaces. Typically, a static load of 300 grams is applied to the filter through a flat disk 12 mm in diameter.

EXAMPLE I

A polypropylene filter tow, 32,000 total denier, was bloomed and a vinyl acetate homopolymer foam was applied to the fiber web. The foam had a density of 0.07 g/cc and a solids content of 47%. The foam was applied to provide fiber-to-fiber bonding with the following results:

| Application Rate (% of Dry Filter Weight) | Coresta Firmness |
|---|---|
| 0% | 76.0% |
| 15% | 90.6% |

EXAMPLE II

A cellulose acetate filter tow, 40,000 total denier, was processed in the same manner as described in Example I, with the following results:

| Application Rate (% of Dry Filter Weight) | Coresta Firmness |
|---|---|
| 0% | 85.3% |
| 15% | 89.9% |
| 25% | 91.3% |

EXAMPLE III

A mixture of 2.25 parts of chemically modified fatty acids (sold by W. R. Grace & Co. under the trademark HAMPOSYL®), 37 parts triacetin, 60.5 parts water and 0.25 parts starch were foamed to a density of 0.12 g/cc and applied to a 40,000 total denier cellulose acetate tow, with the following results:

| Application Rate (% of Dry Filter Weight) | Coresta Firmness |
|---|---|
| 0% | 85.3% |
| 2.3% | 88.2% |
| 5.5% | 89.5% |

It may be seen that filter rods formed in accordance with this invention have greater firmness than untreated filter rods, even at low application rates.

Thus, a method is provided whereby additives can be applied to filter tow material at low application rates and with uniform distribution. It will be apparent to one skilled in the art that the inventive principles disclosed herein can be practiced by other than the examples described, which are presented for the purposes of illustration and not of limitation, and the present invention is limited only by the claims which follow.

What is claimed is:

1. A method of producing a cigarette filter rod, said method comprising the steps of:

providing a moving stream of filamentary filter material;

applying a liquid additive foam to said moving stream of filter material; and gathering said moving stream of filter material after said applying step to form said cigarette filter rod.

2. The method of claim 1 wherein said filter material is cellulose acetate tow.

3. The method of claim 1 wherein said filter material is polypropylene tow.

4. The method of claim 3 wherein said polypropylene tow is fibrillated.

5. The method of claim 1 wherein said liquid additive foam comprises a plasticizer.

6. The method of claim 1 wherein said liquid adhesive foam comprises a humectant.

7. The method of claim 1 wherein said liquid additive foam comprises a bonding agent.

8. The method of claim 1 wherein said liquid additive foam comprises a flavoring agent.

9. The method of claim 8 wherein said flavoring is encapsulated in an encapsulating agent.

10. The method of claim 9 wherein said encapsulating agent is a resin.

11. The method of claim 9 wherein said encapsulating agent is a binder.

12. In a method for producing a cigarette filter rod, said method including the steps of providing a moving stream of filamentary filter material, blooming said filter material in said moving stream, gathering said bloomed filter material to form said cigarette filter rod, and providing an outer layer for said cigarette filter rod, the additional step of:

applying a liquid additive foam to said moving stream of filter material after the beginning of said blooming step and before completion of said gathering step.

13. The method of claim 12 wherein said applying step is carried out before beginning said gathering step.

14. The method of claim 12 wherein said applying step is carried out during said gathering step.

15. The method of claim 12 wherein said liquid additive foam comprises a plasticizer.

16. The method of claim 12 wherein said liquid additive foam comprises a humectant.

17. The method of claim 12 wherein said liquid additive foam comprises a bonding agent.

18. The method of claim 12 wherein said liquid additive foam comprises a flavoring agent.

19. The method of claim 18 wherein said flavoring is encapsulated in an encapsulating agent.

20. The method of claim 19 wherein said encapsulating agent is a resin.

21. The method of claim 19 wherein said encapsulating agent is a binder.

* * * * *

UNITED STATES PATENT AND TRADEMARK OFFICE

CERTIFICATE OF CORRECTION

PATENT NO. : 4,756,316

DATED : July 12, 1988

INVENTOR(S) : Gus D. Keritsis et al.

It is certified that error appears in the above-identified patent and that said Letters Patent is hereby corrected as shown below:

Cover page, under "[56] References Cited, U.S. PATENT DOCUMENTS", after "4,524,589 6/1985 Fleissner ." should be inserted:
-- 4,619,276 10/1986 Albertson et al. . --.

Cover page, under "[56] References Cited, FOREIGN PATENT DOCUMENTS", before "1561706 2/1980 United Kingdom ." should be inserted:
-- 1194574 6/1970 United Kingdom .
1257290 12/1971 United Kingdom . --.

Cover page, under "[56] References Cited, FOREIGN PATENT DOCUMENTS", after "1561706 2/1980 United Kingdom ." should be inserted:
-- 2090774 7/1982 United Kingdom . --.

Column 3, line 4, "br" should be -- or --.

Claim 1, column 5, line 15, "material; and" should be -- material;
controlling collapse of said foam into said moving stream of filter material; and --

Claim 12, column 6, line 11, "step" should be -- steps --.

UNITED STATES PATENT AND TRADEMARK OFFICE

CERTIFICATE OF CORRECTION

PATENT NO. : 4,756,316

DATED : July 12, 1988

INVENTOR(S) : Gus D. Keritsis et al.

It is certified that error appears in the above-identified patent and that said Letters Patent is hereby corrected as shown below:

Claim 12, column 6, line 15, "step." should be -- step; and controlling collapse of said foam into said moving stream of filter material. --.

Signed and Sealed this

Nineteenth Day of March, 1991

*Attest:*

HARRY F. MANBECK, JR.

*Attesting Officer*

*Commissioner of Patents and Trademarks*